US010837717B2

(12) United States Patent
Andersson

(10) Patent No.: US 10,837,717 B2
(45) Date of Patent: Nov. 17, 2020

(54) HEAT EXCHANGER WITH IMPROVED FLOW

(71) Applicant: SWEP International AB, Landskrona (SE)

(72) Inventor: Sven Andersson, Hässleholm (SE)

(73) Assignee: SWEP International AB, Landskrona (SE)

( * ) Notice: Subject to any disclaimer, the term of this patent is extended or adjusted under 35 U.S.C. 154(b) by 0 days.

(21) Appl. No.: 15/103,242

(22) PCT Filed: Nov. 28, 2014

(86) PCT No.: PCT/EP2014/075956

§ 371 (c)(1),
(2) Date: Jun. 9, 2016

(87) PCT Pub. No.: WO2015/086343

PCT Pub. Date: Jun. 18, 2015

(65) Prior Publication Data

US 2016/0313071 A1 Oct. 27, 2016

(30) Foreign Application Priority Data

Dec. 10, 2013 (SE) ..... 1351472

(51) Int. Cl.
*F28F 3/04* (2006.01)
*F28F 3/02* (2006.01)
(Continued)

(52) U.S. Cl.
CPC ..... *F28F 3/046* (2013.01); *F28D 1/0308* (2013.01); *F28D 9/005* (2013.01); *F28D 9/0025* (2013.01);
(Continued)

(58) Field of Classification Search
CPC .... F28F 3/08; F28F 8/083; F28F 3/086; F28F 3/10; F28F 3/046; F28F 3/044; F28F 3/04;
(Continued)

(56) References Cited

U.S. PATENT DOCUMENTS 3,532,161 A * 10/1970 Loebel ..... F28D 9/0093 165/167
3,661,203 A * 5/1972 Mesher ..... F28F 3/046 165/167
(Continued)

FOREIGN PATENT DOCUMENTS

CA 2470557 A1 * 6/2003 ..... F28D 9/0037
DE 2450739 A1 * 4/1976 ..... F28D 9/0031
(Continued)

OTHER PUBLICATIONS

WO 2013080256 A1 Machine Translation English—Retrieved Jun. 2017.*
(Continued)

*Primary Examiner* — Len Tran
*Assistant Examiner* — Jenna M Hopkins
(74) *Attorney, Agent, or Firm* — Merchant & Gould P.C.

(57) ABSTRACT

A heat exchanger comprises a number of identical heat exchanger plates stacked in a stack. Every other heat exchanger plate is turned 180 degrees in its plane relative to its neighboring plates, and each heat exchanger plate comprises at least four port openings and a herringbone pattern comprising pressed ridges and grooves. The ridges and grooves are adapted to keep the plates on a distance from one another under formation of flow channels, wherein areas around the port openings are arranged on different levels, such that selective flow from the port openings to the flow channels is achieved. Dents are arranged in the ridges and
(Continued)

grooves in the vicinity of any of the port openings, the dents being arranged to increase the flow resistance to promote a more even flow distribution in the flow channel.

4 Claims, 3 Drawing Sheets

(51) Int. Cl.

| | |
|---|---|
| ***F28F 13/06*** | (2006.01) |
| ***F28F 13/02*** | (2006.01) |
| ***F28D 9/00*** | (2006.01) |
| ***F28F 3/08*** | (2006.01) |
| ***F28F 13/12*** | (2006.01) |
| ***F28D 1/03*** | (2006.01) |
| ***F28F 3/10*** | (2006.01) |
| ***F28F 9/02*** | (2006.01) |
| ***F28F 13/08*** | (2006.01) |

(52) U.S. Cl.
CPC ..... *F28D 9/0031* (2013.01); *F28D 9/0037* (2013.01); *F28D 9/0043* (2013.01); *F28F 3/02* (2013.01); *F28F 3/04* (2013.01); *F28F 3/042* (2013.01); *F28F 3/044* (2013.01); *F28F 3/08* (2013.01); *F28F 3/083* (2013.01); *F28F 3/086* (2013.01); *F28F 3/10* (2013.01); *F28F 9/026* (2013.01); *F28F 13/02* (2013.01); *F28F 13/06* (2013.01); *F28F 13/08* (2013.01); *F28F 13/12* (2013.01); *F28F 2250/10* (2013.01); *F28F 2275/04* (2013.01)

(58) Field of Classification Search
CPC .... F28F 3/02; F28F 3/042; F28F 13/02; F28F 13/06; F28F 13/08; F28F 13/12; F28F 2250/10; F28D 9/0025; F28D 1/0308; F28D 9/0031; F28D 9/0037
USPC ..... 165/167, 166
See application file for complete search history.

(56) References Cited

U.S. PATENT DOCUMENTS 3,783,090 A * 1/1974 Andersson et al. ..... F28F 3/04 165/166
3,792,730 A * 2/1974 Andersson ..... F28F 3/083 165/167
3,817,324 A * 6/1974 Andersson ..... F28F 3/046 165/167
3,931,854 A * 1/1976 Ivakhnenko ..... F28D 9/0037 165/166
4,781,248 A * 11/1988 Pfeiffer ..... F28D 9/005 165/166
4,915,165 A * 4/1990 Dahlgren ..... F28F 3/046 165/166
4,966,227 A * 10/1990 Andersson ..... F28F 3/046 165/166
4,987,955 A * 1/1991 Bergqvist ..... F28D 9/005 165/166
5,398,751 A * 3/1995 Blomgren ..... F28D 9/005 165/166
5,531,269 A * 7/1996 Dahlgren ..... F28D 9/005 165/167
5,727,620 A * 3/1998 Schaufele ..... F28F 3/10 165/166
5,971,065 A * 10/1999 Bertilson ..... F28F 9/026 165/153
6,394,178 B1 * 5/2002 Yoshida ..... F28D 9/005 165/166
7,213,635 B2 * 5/2007 Persson ..... F28D 9/005 165/167
8,109,326 B2 * 2/2012 Larsson ..... F28F 3/046 165/167
8,387,248 B2 * 3/2013 Rolt ..... B21D 53/02 165/167
8,746,329 B2 * 6/2014 Blomgren ..... F28D 9/005 165/166
9,217,608 B2 * 12/2015 Krantz ..... F28F 3/10
9,400,142 B2 * 7/2016 Holm ..... F28F 3/046
9,448,013 B2 * 9/2016 Ito ..... F28F 3/046
9,518,782 B2 * 12/2016 Blomgren ..... F28D 9/005
2001/0030043 A1 * 10/2001 Gleisle ..... B23K 1/0012 165/167
2004/0206488 A1 * 10/2004 Ikuta ..... F28D 1/0341 165/167
2005/0039898 A1 * 2/2005 Wand ..... F28D 9/005 165/167
2006/0162915 A1 * 7/2006 Matsuzaki ..... F28F 3/04 165/166
2007/0000654 A1 * 1/2007 Matsuzaki ..... F28D 9/0043 165/167
2007/0107890 A1 * 5/2007 Geskes ..... F28D 9/005 165/167
2008/0029257 A1 * 2/2008 Nilsson ..... F28F 3/04 165/167
2008/0196874 A1 * 8/2008 Bertilsson ..... F28D 9/005 165/167
2008/0210414 A1 * 9/2008 Blomgren ..... F28F 3/025 165/166
2008/0283231 A1 * 11/2008 Horte ..... F28D 9/005 165/167
2009/0133861 A1 * 5/2009 Kim ..... F24H 1/48 165/140
2009/0178793 A1 * 7/2009 Larsson ..... F28F 3/046 165/173
2010/0276125 A1 * 11/2010 Krantz ..... F28F 3/10 165/134.1
2011/0139419 A1 * 6/2011 Blomgren ..... F28D 9/005 165/170
2011/0240273 A1 * 10/2011 Blomgren ..... F28F 3/083 165/168
2012/0031598 A1 * 2/2012 Han ..... F28D 1/0333 165/170
2012/0118546 A1 * 5/2012 Andersson ..... F28D 9/005 165/170
2012/0125578 A1 * 5/2012 Persson ..... F28D 9/0093 165/133
2012/0325434 A1 * 12/2012 Blomgren ..... F28F 3/046 165/104.19
2013/0113126 A1 * 5/2013 Mockry ..... F28C 1/16 261/112.1
2013/0126135 A1 * 5/2013 Romlund ..... F28D 9/005 165/133
2013/0180699 A1 * 7/2013 Dahlberg ..... F28D 9/0031 165/185
2013/0192291 A1 * 8/2013 Ito ..... F28D 9/005 62/324.1
2013/0327513 A1 * 12/2013 Franz ..... F28F 21/04 165/185
2014/0026577 A1 * 1/2014 Reinke ..... F01N 3/0205 60/670
2014/0034276 A1 * 1/2014 Persson ..... F28F 3/10 165/167
2015/0184954 A1 * 7/2015 Bertilsson ..... F28D 9/005 165/96
2015/0276319 A1 * 10/2015 Hedberg ..... F28F 3/046 165/166
2016/0187076 A1 * 6/2016 Blomgren ..... F28D 9/0012 165/80.1
2016/0245591 A1 * 8/2016 Masgrau ..... F28F 3/046
2016/0250703 A1 * 9/2016 Bornegard ..... B23K 1/0012 165/167
2016/0313066 A1 * 10/2016 Andersson ..... F28F 3/042
2017/0016680 A1 * 1/2017 Zhang ..... F28F 3/042

(56) References Cited

U.S. PATENT DOCUMENTS

| | | | | | |
|---|---|---|---|---|---|
| 2018/0106558 | A9 * | 4/2018 | Buckrell | ..... | F28D 9/0056 |
| 2019/0360768 | A1 * | 11/2019 | Dahlberg | ..... | F28F 27/00 |

FOREIGN PATENT DOCUMENTS

| | | | | | |
|---|---|---|---|---|---|
| DE | 9408904 | U1 * | 8/1994 | ..... | F28F 3/044 |
| DE | 102012022046 | A1 * | 5/2014 | ..... | F28F 3/044 |
| EP | 0204880 | A2 * | 12/1986 | ..... | F28F 3/083 |
| EP | 0252275 | A2 | 1/1988 | | |
| EP | 2267391 | A2 * | 12/2010 | ..... | F28D 9/005 |
| EP | 2420791 | A2 | 2/2012 | | |
| EP | 3093602 | A1 * | 11/2016 | ..... | F28F 9/0075 |
| JP | S56-039294 | A | 9/1982 | | |
| JP | 08219677 | A * | 8/1996 | ..... | F28F 3/044 |
| JP | 2011-517764 | A | 6/2011 | | |
| JP | WO 2013080256 | A1 * | 6/2013 | ..... | F28F 3/046 |
| WO | WO-9300563 | A1 * | 1/1993 | ..... | F28F 3/046 |
| WO | WO-2009128750 | A1 * | 10/2009 | ..... | B01J 35/04 |
| WO | WO-2009154543 | A1 * | 12/2009 | ..... | F28D 9/005 |
| WO | WO-2010016792 | A1 * | 2/2010 | ..... | F01N 3/2821 |
| WO | WO-2010069873 | A1 * | 6/2010 | ..... | F28D 9/005 |
| WO | WO 2010069873 | A1 * | 6/2010 | ..... | F28D 9/005 |
| WO | WO-2012004100 | A1 * | 1/2012 | ..... | F28D 9/0031 |

OTHER PUBLICATIONS

WO-2010069873-A1 (Year: 2010).*
International Search Report for No. PCT/EP2014/075956, dated Feb. 4, 2015 (3 pages).
English Translation of Office Action for Japanese Patent Application No. 2016-536119, dated Sep. 4, 2018.

* cited by examiner

HEAT EXCHANGER WITH IMPROVED FLOW

This application is a National Stage Application of PCT/EP2014/075956, filed 28 Nov. 2014, which claims benefit of application Ser. No. 1351472-4, filed 10 Dec. 2013 in Sweden, and which applications are incorporated herein by reference. To the extent appropriate, a claim of priority is made to each of the above disclosed applications.

FIELD OF THE INVENTION

The present invention relates to a heat exchanger comprising a number of identical heat exchanger plates stacked in a stack, wherein every other heat exchanger plate is turned 180 degrees in its plane relative to its neighboring plates, and wherein each heat exchanger plate comprises at least four port openings and a herringbone pattern comprising pressed ridges and grooves, said ridges and grooves being adapted to keep the plates on a distance from one another under formation of flow channels, wherein areas around the port openings are arranged on different levels, such that selective flow from the port openings to the flow channels is achieved.

PRIOR ART

The most common type of heat exchanger is the type of heat exchangers comprising a number of identical heat exchanger plates, each comprising port openings, the surrounding areas of which being located at different heights to arrange for selective fluid communication into flow channels arranged by interaction between pressed patterns of ridges and grooves of neighboring heat exchanger plates.

As well known by persons skilled in the art of heat exchangers, heat exchangers of the type described above have one small drawback compared to heat exchangers made from non-identical plates, namely that inlet and outlet port openings for one of the fluids are placed on one side of the axis of the heat exchanger, whereas the openings for the other fluid are place placed on the other side of the axis.

This leads to a slight maldistribution of the fluids to exchange heat, since there is a shorter way (and hence less resistance) for the fluids to travel in a straight line from port opening to port opening. A majority of the flow of each fluid will hence flow shifted towards one side of the heat exchanger, compared to the axis of the heat exchanger. Obviously, the optimum distribution would be an even flow of both fluids in the flow channels arranged by the neighboring plates.

The maldistribution problem is even more pronounced for heat exchangers having a large width as compared to its length—an old "rule of thumb" indicates that the length preferably should be 1.7 times the width in order to get an acceptable heat exchanger efficiency.

In US 2007/0107890, the problem of sideways maldistribution is addressed by providing contact points between neighbouring plates such that the flow of fluid therein has a larger flow resistance in the sideways direction as compared to the linear direction of the flow. Supposedly, this will force the fluid to flow in a more positive direction and hence reduce maldistribution problems.

EP 2 420 791 discloses a radiator type plate heat exchanger for exchanging heat between a fluid flowing in a flow channel and ambient air. In order to avoid stagnant flow behind port openings, flow guide structures provided on sides of the port opening are arranged to decrease the flow resistance, such that a stagnant area around the port opening is avoided. Sideways maldistribution of the flow is not mentioned, and the design of this document also does not affect sideways maldistribution, since both sides of the port openings are provided with identical flow guide structures.

The present invention aims to improve the flow distribution in a heat exchanger made from identical heat exchanger plates.

SUMMARY OF THE INVENTION

The present invention solves the above and other problems by providing a heat exchanger of the type mentioned above, with the added features of dents arranged in the ridges and grooves in the vicinity of any of the port openings. The dents are arranged to increase the flow resistance to promote a more even flow distribution in said flow channel.

In one embodiment of the invention, said dents are placed such that contact points between said ridges and grooves of the neighbouring plates in the stack are not affected by said dents. This increases the strength of the heat exchanger.

If not enough effect on the flow distribution is achieved by the arrangement above, dents may be provided around two neighboring port openings, wherein the dents in the vicinity of one of said neighboring port openings are placed in the ridges, and the dents in the vicinity of the other of the two neighboring port openings are placed in the grooves.

In order to achieve a cost efficient heat exchanger, the heat exchanger plates in the stack may be joined by brazing.

BRIEF DESCRIPTION IF THE DRAWINGS

Hereinafter, the invention will be described with reference to the appended drawings, wherein.

DESCRIPTION OF EMBODIMENTS

Figure 1:
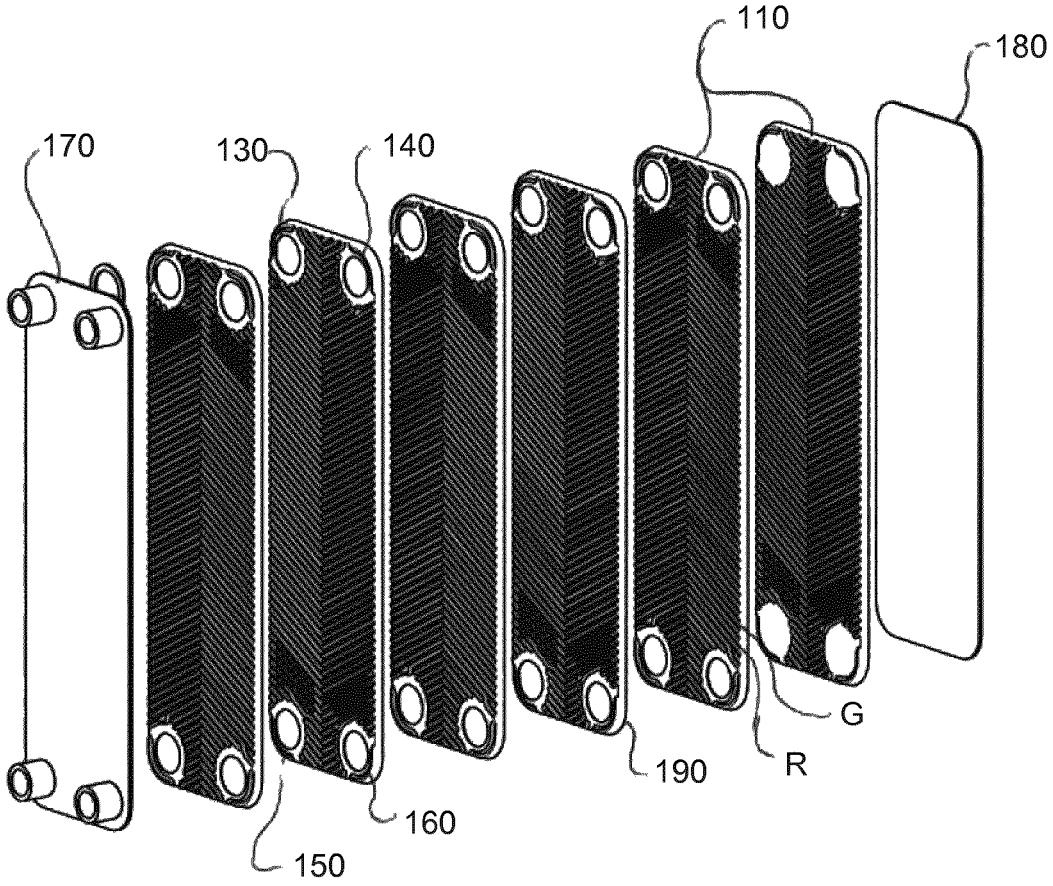
FIG. 1 is an exploded perspective view of a heat exchanger comprising six identical heat exchanger plates.

With reference to FIG. 1, a heat exchanger 100 according to the present invention comprises a number of identical heat exchanger plates 110, each comprising four port openings 130, 140, 150 and 160, the openings 130, 150 being inlet openings and outlet openings, respectively, for a first fluid, the openings 160, 140 being inlet openings and outlet openings, respectively, for a second fluid intended to exchange heat with the first fluid.

The plates also comprise ridges R and grooves G arranged in a herringbone pattern and adapted to keep the plates on a distance from one another under formation of flow channels. Areas around the port openings are arranged on different heights in order to allow for selective fluid flow to the flow channels. The areas around the port openings 130 and 150 are provided on the same height, e.g. the height of the ridges R, whereas the areas around the port openings 140, 150 are provided on another height, e.g. the height of the grooves G.

Two neighboring plates are always mutually turned by 180 degrees in the plane, i.e. such that port openings 130 and 160 will neighbor one another, and port openings 150 and 140 will neighbor one another. As mentioned earlier, the areas surrounding the ports are arranged on different heights, meaning that one pair of port openings placed on one side of the axis of the plates will allow fluid flow into the flow channels arranged by the neighboring plates, whereas the other pair of port openings will be closed, i.e. not allow fluid flow into the same channel. However, the same pair of port openings will be in fluid communication with the flow channels arranged by the next neighboring heat exchanger plate.

Moreover, the heat exchanger plates are provided with a skirt 190 extending around the periphery of the plates 110. The skirts of neighboring plates are arranged to seal the flow channels, such that no leakage to and from the flow channels is allowed.

Finally, end plates 170, 180 are arranged on the outside of the stack of heat exchanger plates. The purpose of the end plates is to increase the strength, i.e. pressure capability of the heat exchanger. Should the pressure requirements be low, the end plates could be omitted.

Figure 2:
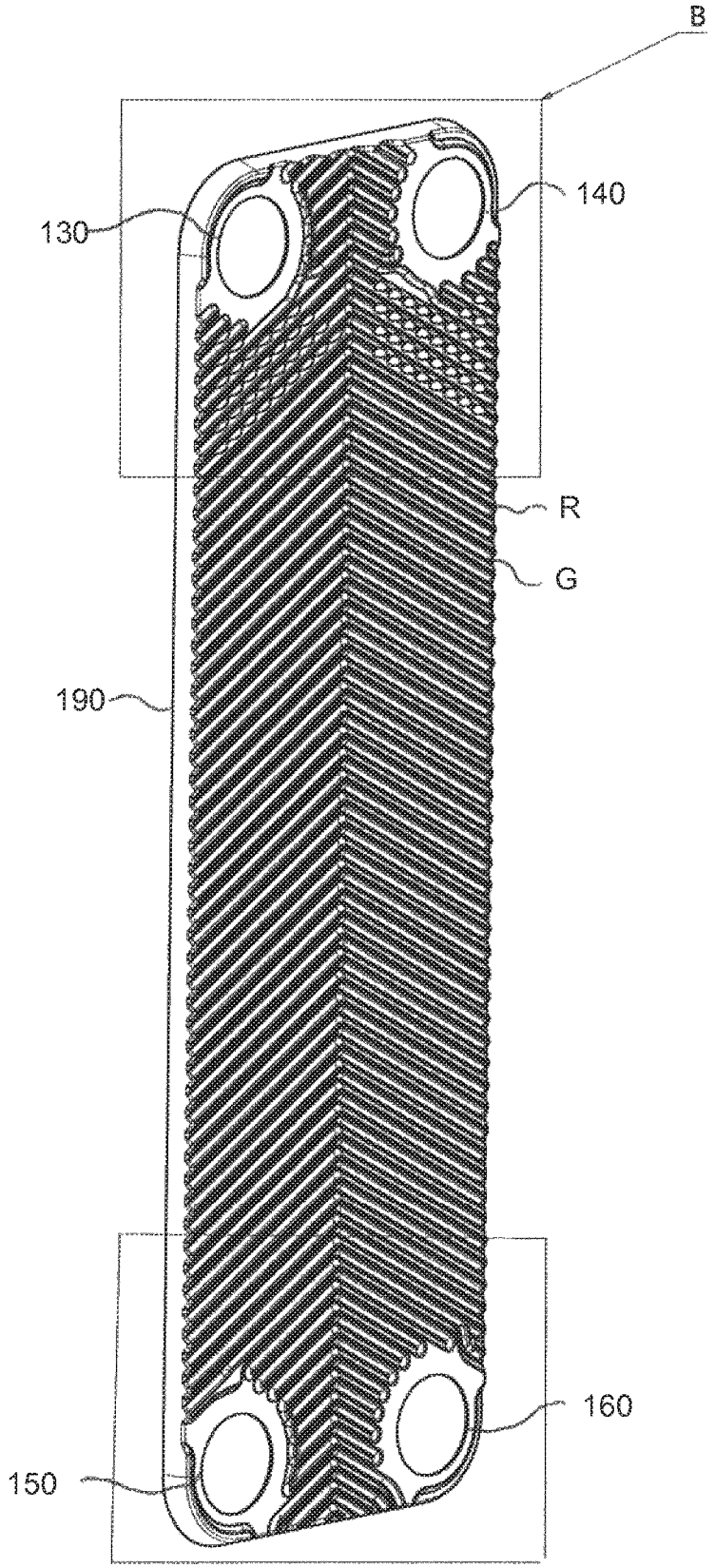
FIG. 2 is a perspective view showing one of the heat exchanger plates in FIG. 1.
Figure 3:
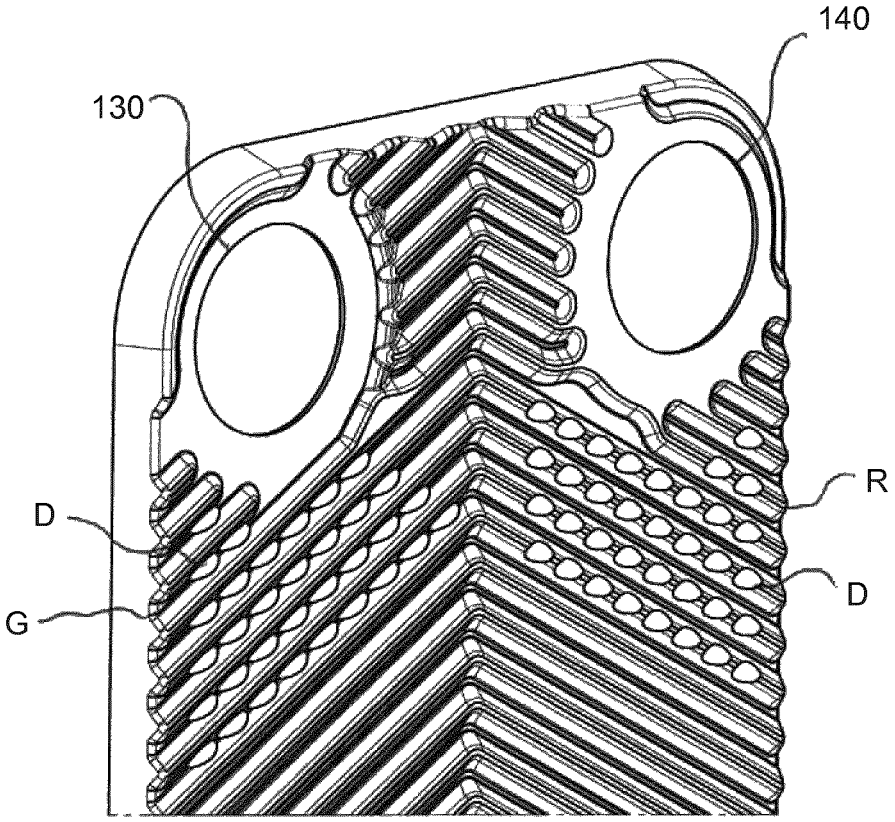
FIG. 3 is a perspective view showing the area denoted B in FIG. 2.

FIG. 2 shows one of the heat exchanger plates 110; in this figure, some irregularities of the herringbone pattern comprising the ridges and grooves R and G, respectively, are shown in the vicinity of the port openings 130 and 140. In FIG. 3, this area (denoted by B in FIG. 2), is shown in greater detail. In the vicinity of the port openings 150 and 160, the herringbone pattern is not irregular.

As can be seen in FIG. 3, the herringbone pattern comprising ridges R and grooves G is interrupted by dents D; in the vicinity of the port opening 130, the dents D are arranged in the grooves G, whereas in the vicinity of the port opening 140, the dents D are placed in the ridges R.

As mentioned above, the heat exchanger plates are stacked onto one another, wherein each other plate is turned 180 degrees relative to its neighboring plates. If one imagines a plate 110 being placed on top of the plate partly shown in FIG. 3, and turned 180 as compared to this plate, it is clear that the port opening 130 will be open to the flow channel delimited by these two plates, whereas the port opening 140 will be closed.

The dents D in the grooves G in the vicinity of the port 130 will decrease the flow volume, and hence increase the pressure drop, in the vicinity of the port opening 130, whereas the dents D in the ridges R in the vicinity of the port opening 140 will increase the flow volume, and hence decrease the pressure drop for a fluid travelling the flow channel. Considering the port opening 130 is an inlet opening, the fluid will hence be directed towards the side of the axis of the heat exchanger plate where the port opening 140 is placed.

If an identical plate is placed below the plate shown in FIG. 3, the port opening 140 will be open for fluid low into the flow channel delimited by these two plates, and the flow will be directed (or rather urged) to a path on the side of the axis of the heat exchanger plate where the port opening 130 is placed. It is, however, rather unlikely that anyone would place two inlet ports next to one another.

However, due to the identical plates, the impact on the pressure drops, and hence flow distribution will be equal for the port openings 150, 160.

Above, the invention has been described with reference to one single embodiment, which results in a significant improvement in the flow distribution of a plate heat exchanger made from a stack of identical heat exchanger plates, wherein every other plate is turned 180 degrees in the plane as compared to its neighboring plates. In the shown embodiment, this is achieved by providing both the ridges and the grooves of the herringbone pattern holding the plates on a distance from one another by contacting point with dents D. It is, however, possible to achieve the same result by only providing e.g. the grooves G in the vicinity of the port opening 130 with dents, or only the ridges R in the vicinity of the port opening 140 with dents D.

It is also possible to provide the grooves G in the vicinity of both port openings 130 and 150 with dents and the ridges R in the vicinity of both port openings 140, 160 with dents.

The invention could be used both for brazed heat exchangers and for packed heat exchangers, i.e. heat exchangers where the sealing around edge portions and port openings is provided by gaskets.

The invention claimed is:

1. A heat exchanger comprising:

(a) a number of identical heat exchanger plates stacked in a stack, wherein every other heat exchanger plate is turned 180 degrees in its plane relative to neighboring heat exchanger plates, and wherein each heat exchanger plate comprises at least four port openings and a herringbone pattern comprising pressed ridges and grooves;

(b) said ridges and grooves of the herringbone pattern providing contact points between neighboring heat exchanger plates and keeping the heat exchanger plates a distance from one another and providing flow channels, wherein said flow channels comprise a first flow channel and a second flow channel, wherein areas around the port openings are arranged on different levels, such that selective flow from the port openings to the flow channels is achieved;

(c) said port openings comprising a first inlet port opening open to said first flow channel and closed to said second flow channel, and a second inlet port opening closed to said first flow channel and open to said second flow channel; and (d) wherein, seen from a frontal side of the heat exchanger plates, dents are arranged in the grooves of the herringbone pattern of the heat exchanger plates immediately adjacent said first inlet port opening, and dents are not arranged in the grooves of the herringbone pattern of the heat exchanger plates immediately adjacent said second inlet port opening, said dents in the grooves of the herringbone pattern being arranged to increase a flow resistance for fluid traveling in said first flow channel such that the fluid is directed toward a side of the heat exchanger plate where the second inlet port opening is placed to thereby promote a more even flow distribution in said flow channels, wherein said dents in the grooves of the herringbone pattern are placed such that said dents in the grooves of the herringbone pattern do not form contact points with the neighboring heat exchanger plates.

2. The heat exchanger of claim 1, wherein the dents are provided around two neighboring port openings, and wherein the dents in the areas of one of said neighboring port openings are placed in the ridges, and the dents in the areas of the other of the two neighboring port openings are placed in the grooves.

3. The heat exchanger of claim 1, wherein the heat exchanger plates in the stack are joined by brazing.

4. A heat exchanger comprising:

(a) a number of identical heat exchanger plates stacked in a stack, wherein every other heat exchanger plate is turned 180 degrees in its plane relative to neighboring heat exchanger plates, and wherein each heat exchanger plate comprises at least four port openings and a herringbone pattern comprising pressed ridges and grooves;

(b) said ridges and grooves of the herringbone pattern providing contact points between neighboring heat exchanger plates and keeping the heat exchanger plates a distance from one another and providing flow channels, wherein the said flow channels comprise a first flow channel and a second flow channel, wherein areas around the port openings are arranged on different levels, such that selective flow from the port openings to the flow channels is achieved;

(c) said port openings comprising a first inlet port opening open to said first flow channel and closed to said second flow channel, and a second inlet port opening closed to said first flow channel and open to said second flow channel; and (d) wherein, seen from a frontal side of the heat exchanger plates, dents are arranged in the ridges of the herringbone pattern of the heat exchanger plates immediately adjacent said second inlet port opening, and dents are not arranged in the ridges of the herringbone pattern of the heat exchanger plates immediately adjacent said first inlet port opening, said dents in the ridges of the herringbone pattern being arranged to decrease a flow resistance for fluid traveling in said second flow channels to thereby promote a more even flow distribution in said flow channels, wherein said dents in the ridges of the herringbone pattern in the heat exchanger plates are placed such that said dents in the ridges of the herringbone pattern do not form contact points with the neighboring heat exchanger plates.

* * * * *